United States Patent [19]

Sawruk

[11] Patent Number: 4,942,820

[45] Date of Patent: Jul. 24, 1990

[54] FRAGMENTATION DEVICE

[76] Inventor: Stephen D. Sawruk, P.O. Box 431, Lanoka Harbor, N.J. 08734

[21] Appl. No.: 381,193

[22] Filed: Jul. 18, 1989

Related U.S. Application Data

[63] Continuation-in-part of Ser. No. 270,789, Nov. 14, 1988, abandoned, which is a continuation-in-part of Ser. No. 161,977, Feb. 29, 1988, abandoned.

[51] Int. Cl.[5] ..... F42B 27/00

[52] U.S. Cl. ..... 102/482; 102/487; 102/499; 102/493

[58] Field of Search ..... 102/482, 498, 202.5, 102/334, 367, 368, 487, 499, 301, 303, 306, 314, 401, 491, 492, 493, 496; 428/40; 206/460, 813

[56] References Cited

U.S. PATENT DOCUMENTS

| | | | |
|---|---|---|---|
| H215 | 2/1987 | Stewart | 102/487 |
| 1,994,081 | 3/1935 | Willners | 102/261 |
| 3,054,349 | 9/1962 | Plumley | 102/1 |
| 3,117,521 | 1/1964 | Reaves | 102/368 |
| 3,374,737 | 3/1968 | Pike | 102/202.5 |
| 3,447,463 | 6/1969 | Lavine | 102/368 |
| 3,616,753 | 11/1971 | Carlson | 102/482 |
| 3,712,218 | 1/1973 | Fay | 102/216 |
| 3,724,381 | 3/1973 | Gawlick et al. | 102/368 |
| 3,800,939 | 4/1974 | Cornelius | 206/813 |
| 3,851,762 | 12/1974 | Liblick | 206/460 |
| 4,446,179 | 5/1984 | Waugh | 428/40 |
| 4,683,671 | 8/1987 | Farrar | 42/74 |
| 4,756,254 | 7/1988 | Bai et al. | 102/511 |

FOREIGN PATENT DOCUMENTS

| | | | |
|---|---|---|---|
| 2528967 | 12/1983 | France | 102/487 |
| 133347 | 10/1919 | United Kingdom | 102/488 |
| 1149034 | 4/1969 | United Kingdom | 102/482 |

*Primary Examiner*—Harold J. Tudor

*Attorney, Agent, or Firm*—Melvin K. Silverman

[57] ABSTRACT

A fragmentation device includes a core of munitions in the form of a sphere. The sphere of munitions is surrounded by a spherical outer shell of a rubberized material. Further provide is a fuze at the surface of the internal rubberized material which is an electrical communication with a detonator which is embedded within the spherical core of munitions. The rubberized spherical shell is provided with spherically symmetrical fractures which radiate out from the core to insure a symmetrical dispersion of the force associated with the detonated munitions core.

12 Claims, 3 Drawing Sheets

FRAGMENTATION DEVICE

REFERENCE TO RELATED APPLICATION

This case is a Continuation-In-Part of application Ser. No. 07/270/789, filed Nov. 14, 1988, now abandoned, which Application is a Continuation-In-Part application of Ser. No. 07/161,977, filed Feb. 29, 1988, now abandoned, entitled Anti-Terrorist Urban Grenade (ATUG).

BACKGROUND OF THE INVENTION

The hand grenade, in its generally known form, was invented in the 15th Century and has been widely used in warfare since the 17th Century. The present day form and structure of such devices have been basically unchanged since that time.

That specific prior art known to the inventor consists of United States Statutory Invention Registration No. H215 to Stewart, entitled Fuze for Riot Control Grenade; United Kingdom Patent No. 133,347 (1919) to Rushen; United Kingdom Patent No. 1,149,039 (1969) to Aktiebolag; and French Patent No. 2,528,967 (1982) to Chevallier.

The above, and other prior art known to the inventor, does not disclose a fragmentation device having an exterior surface capable of imparting a sufficient "bounce" or resilience to the device to permit the device to be rebounded off of flat surfaces to thereby reach a target which is not within a line of sight of the user of the device.

The utility of such device is particularly great in the area of urban combat in which combatants are rarely within a line of sight of each other and are, of course, reluctant to expose themselves to a possible line of sight of an enemy.

SUMMARY OF THE INVENTION

The invention constitutes a fragmentation device comprising a spherical munitions core having an exterior surface. The fragmentation device further includes a detonation means integrally disposed within said core, the detonation means comprising electrical connection means extending radially outwardly beyond said munitions core. The device yet further includes a rubberized spherical shell disposed about said munitions core and in mechanical communication with the exterior surface thereof, said rubberized shell having a plurality of symmetrical, radiating fractures to thereby define a plurality of radiating spherical segments to permit symmetrical dispersal of the munitions core and its related explosive force, upon detonation of the core. Also provided is fuse means for selectively actuating said detonation means, said fuse means being in electrical communication with said detonation means. There is optionally provided programming means for arming and timing the device. The plurality of symmetric fractures radiating out from the core insures a symmetric dispersal of the detonated device.

It is an object of the present invention to provide a fragmentation device particularly adapted for use in urban combat situations in which a line of sight between the user and the target is not available or desirable.

It is another object of the present invention to provide a device of the above type having particular utility in anti-terrorist situations.

It is a further object to provide a fragmentation device capable of skipping or rebounding off of a planar surface to thereby reach a target which would otherwise not be visible to the user.

It is a yet further object of the present invention to provide a device of the above type having decreased weight and thereby increased range, by reason of a reduced amount of metal surrounding the munitions core thereof.

The above and yet other objects and advantages of the present invention will become apparent from the hereinafter set forth Detailed Description of the Invention, the Drawings, and Claims appended herewith.

DETAILED DESCRIPTION OF THE INVENTION

Figure 1:
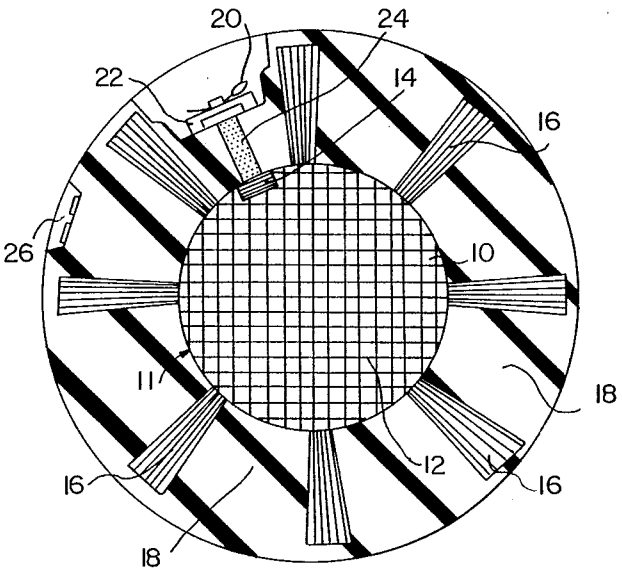
FIG. 1 is a radial hemispherical view of a first embodiment of the inventive fragmentation device.

With reference to the view of FIG. 1, the inventive fragmentation device is seen to include a munitions core 10 having an exterior surface 11 which is surrounded by a mesh of thin detonation wires 12 which wires are in electrical communication with a detonator 14.

The internal munitions core 10 may vary in regard to the specific use contemplated, for example, the core may make use of materials of the following types: anti-personnel, tear gas, concussion, flash, smoke and chemical. It is to be noted that said munitions core may be enclosed by a metal or other casing.

Radiating outwardly from core 10 are a plurality of radially spoked molded fractures 16. These fractures 16 are in the nature of a radial honeycomb and are incorporated into the mold of a shell 18 of a rubberized material. A suitable such rubberized material may be any high durometer elastomer. As may be noted, the geometry of the spherical segments of the rubberized material induce a symmetric dispersal of the munitions core upon the detonation thereof.

In FIG. 1, there is also shown a conventional fuzing arrangement consisting of a pin and loop 20, fuze 22 and an electrical connection means 24 by which the required detonation signal travels from fuze 22 to detonator 14. It is to be noted that said elements 20 and 22 are countersunk within shell 18.

In terms of the relative dimension of the rubberized spherical shell to the spherical munitions core, the diameter of the shell is approximately twice the diameter of the core, although this relationship may vary in differing applications falling within the scope of the instant invention. However, it is to be noted that the spherical shell 18 is much thicker (see below) than the mere rubber casing or shell employed in the above reference to Stewart.

The diameter of munitions core 10 may therefore be about 1.5 inches, while the diameter of the overall device is about 3 inches. Thus the thickness of shell 18 is about 0.75 inches (20mm). Thereby, the overall device will be approximately the size of a standard baseball, this contributing to ease of delivery thereof. The device's weight will, of course, vary with the particular munition load; however, the resultant weight will be far less than that of a conventional grenade.

In production, the spherical shell is formed by injection of a resilient material into a mold to form two equal halves, each comprising a hollow hemisphere. The halves are then sealed about the munitions core leaving a countersunk depression at or near the equatorial plane for insertion of touch pad 26 which, through electrical means 24, is in electrical communication with the detonator 14 and munitions core 10.

As above noted, a spoked pattern of radiating fractures 16 is provided in the mold for the two halves of the outer shell 18.

Touch pad 26 will incorporate an arming code which will deter use of the weapon by unauthorized personnel.

Due to the elimination of the conventional metal casing, the weight of the resultant device is such that the standard effective range of a grenade, namely, 30 to 50 yards, can be doubled or tripled. In addition, the device can, as noted above in the Summary of the Invention, be used to carom or rebound off of various surfaces, walls and the like to reach an enemy or target which would be inaccessible to the flight of a normal hand-held prior art fragmentation device. Clearly, urban warfare, anti-terrorist, hostage situations and the like, involving combat within close confines is where the present device is of maximum value. More particularly, where an enemy is hidden behind a wall, around a corner, or within an alleyway, it can be reached using the right angle of an opposing wall or structure to rebound the inventive device to the location of the enemy.

Figure 2:
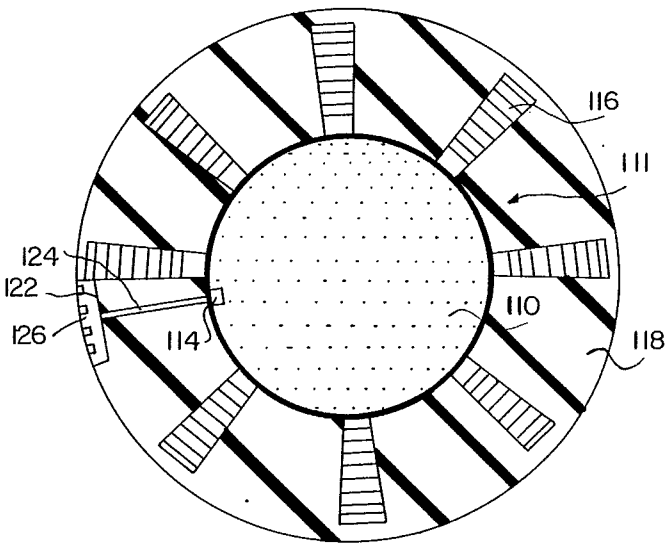
FIG. 2 is a radial hemispherical view of a second embodiment thereof.

In the view of FIG. 2 is shown a second embodiment which includes an optional touch pad 126 which may be used for purposes of programming fuze 122 for activation at a future time. It is further noted that detonator 114 is in electrical communication with electrical connection means 124 which, in turn, is in electrical communication with said touch pad 126. It may also be appreciated that fuse 122 encompasses touch pad 126 and electrical connection means 124.

In this and other embodiments, the device may be provided with an adhesive tear strip (not shown) along the equatorial plane of the device which, when torn away, reveals an adhesive for attachment of the fragmentation device to a desired target. In this manner, the present device may be used for purposes of demolition. The embodiment of FIG. 2 also differs from the embodiment of FIG. 1 in its provision of spoked molded fractures 116 which consist of polar segments and in which an exterior surface 111 is more clearly defined.

Figure 3:
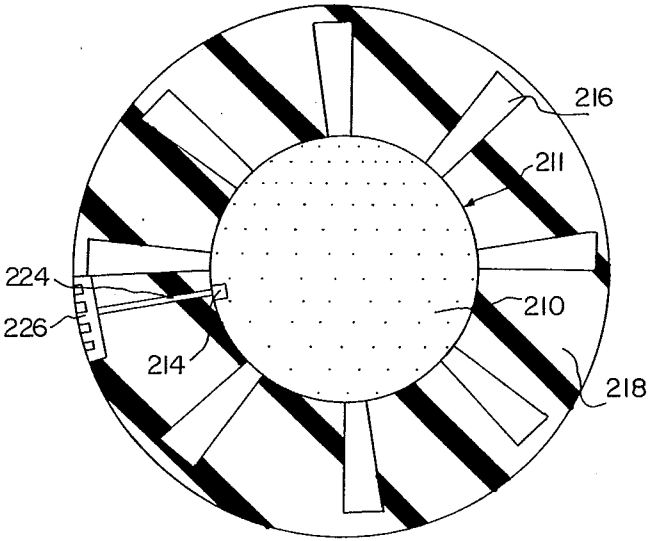
FIG. 3 is a radial hemispherical view of a third embodiment thereof.

In the view of FIG. 3 is shown a third embodiment of the instant invention whichh is generally similar to the embodiment of FIG. 2. However, therein there are provided completely hollow spoked molded fractures 216, this in lieu of the honeycomb fractures shown in the embodiments of FIG. 1 and 2.

Figure 4:
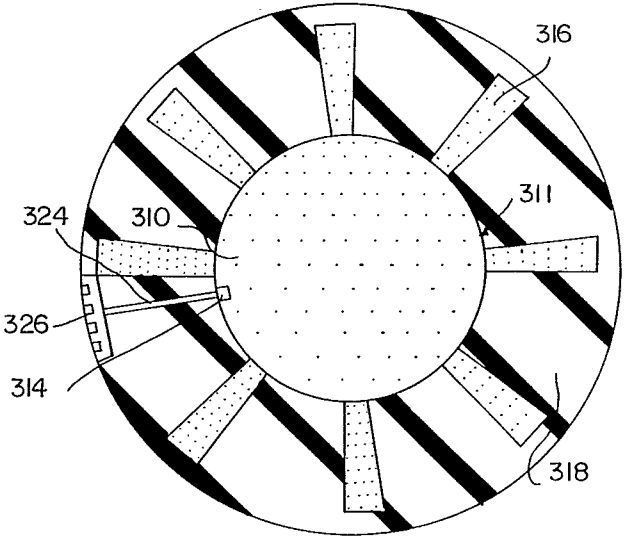
FIG. 4 is a radial hemispherical view of a fourth embodiment thereof.

In reference to FIG. 4 there is shown a fourth embodiment, generally similar to the embodiments of FIGS. 2 and 3, however, employing spoked moled fractures 316 which may be filled with a low density powder. Such low density, high porosity powder performs a function which is analogous to that of the fractures 116 in the embodiment of FIG. 2.

Said embodiments of FIGS. 1 and 2 may, alternatively, be provided with radiating structures comprising a sponge-like material having substantially equal parts by volume of air and resilient material.

In the embodiment of FIG. 3 the radiating cylindrical segments 216 are filled with a pressurized gas such as air.

Figure 5:
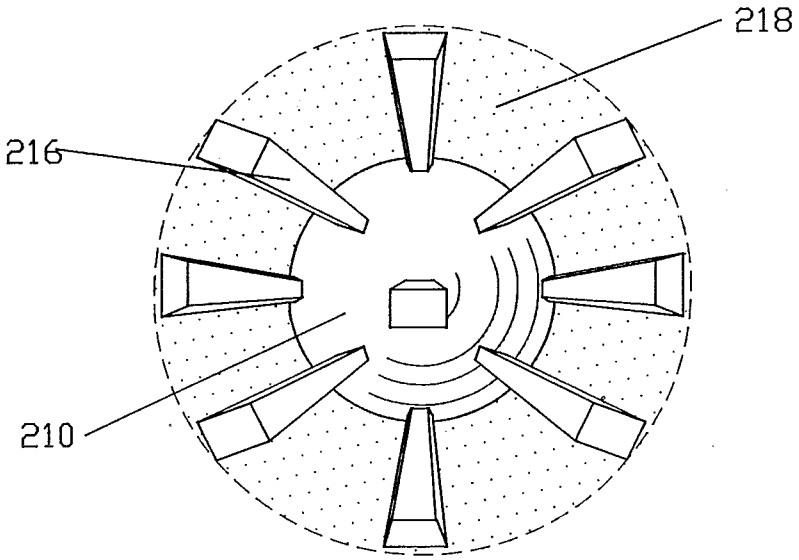
FIG. 5 is a cut away view of the embodiment of FIG. 3.

With reference to FIG. 5 there is shown in partial break-away view the embodiment of FIG. 3 of the fragmentation device. Therein, the partial wedge like configuration of the molded fractures 216 as well as the general interior configuration of the device are shown.

Accordingly, while there has been shown and described with reference to FIG. 1, the preferred embodiment of the present invention, it is to be appreciated that the invention may be embodied otherwise that is herein specifically shown and described and that, within the scope of such embodiment, certain changes may be made within the detail and construction of the parts without departing from the underlying idea or principles of the invention within the scope of the appended claims.

Having thus described my invention, what I claim as new, useful and non-obvious and, accordingly, secure by Letters Patent of the United States is:

1. A fragmentation device, comprising (a) a spherical munition core, the core having an exterior surface;

(b) detonation means integrally disposed within said core, said detonation means comprising electrical connection means extending radially outwardly beyond said exterior surface of said core;

(c) a thick rubberized spherical shell, said shell having a continuous spherical surface, said shell disposed about said munition core and in mechanical communication with the exterior surface of said core, said rubberized shell having therein a plurality of spherically symmetrically radially radiating fractures terminating below said continuous outer surface of said shell, which fractures define, within said symmetrical shell, a plurality of radiating spherical segments, said fractures thereby permitting an uniform symmetrical dispersion of said spherical segments upon detonation of said munition core and of its related explosive forces; and (d) in electrical communication with said detonation means, fuse means, within said rubberized shell situated within said continuous outer spherical surface thereof, for selectively actuating said detonation means.

2. The fragmentation device as recited in claim 1, in which said fuze means comprises:

a manual pin release mechanism.

3. The device as recited in claim 1 in which said fuze means comprises:

a programmable keyboard.

4. The device as recited in claim 1, in which the diameter of said rubberized shell is approximately double the diameter of said munitions core.

5. The device as recited in claim 1, in which said munitions core comprises:

a spherical fragmentation casing enclosing said core.

6. The device as recited in claim 4, in which said radiating fractures comprise:

a radial honeycomb structure.

7. The device as recited in claim 4, in which said radiating fractures comprise:

a honeycomb structure of polar segments.

8. The device as recited in claim 4, in which said radiating fractures comprise:

a powder-like material.

9. The device as recited in claim 4 in which said radiating fractures comprise:

a sponge-like material.

10. The device as recited in claim 9 in which said sponge-like material comprises:

substantially equal parts, by volume, of air and a resilient material.

11. The device as recited in claim 4, in which said fractures comprise hollow wedge like segments.

12. The device as recited in claim 11, in which said speherical segments comprise:

pressured compartments filled with a pressurized gas.

* * * * *